US006646378B2

(12) United States Patent
Kanda

(10) Patent No.: US 6,646,378 B2
(45) Date of Patent: Nov. 11, 2003

(54) PLASMA DISPLAY PANEL AND MANUFACTURING METHOD THEREOF

(75) Inventor: Hiroshi Kanda, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 10/167,404

(22) Filed: Jun. 13, 2002

(65) Prior Publication Data

US 2002/0190649 A1 Dec. 19, 2002

(30) Foreign Application Priority Data

Jun. 14, 2001 (JP) ..... 2001-180357

(51) Int. Cl.[7] ..... H01J 17/49
(52) U.S. Cl. ..... 313/582; 313/485
(58) Field of Search ..... 313/485, 493, 313/582, 584, 634, 292

(56) References Cited

FOREIGN PATENT DOCUMENTS

JP 8-250029 A 9/1996

JP 2001-93425 A 4/2001

*Primary Examiner*—Vip Patel
(74) *Attorney, Agent, or Firm*—Sughrue Mion, PLLC

(57) ABSTRACT

A fluorescent layer (R), fluorescent layer (G), and fluorescent layer (B) are formed according to each column by the screen printing method. As a result, spaces of the approximately the same thickness as the fluorescent layers (R), (G), and (B) exist between regions of the barrier ribs that extend in the column direction and a protective layer. The lowering of the efficiency of exhaust and the efficiency of sealing in discharge gas can thus be avoided. As a result, discharge gas can be made to exist appropriately in the discharge spaces without fail, thereby enabling excellent display characteristics to be obtained. Furthermore, since display cells that neighbor each other in the column direction are partitioned by barrier ribs, erroneous discharge will not occur. The non-discharge gap can thus be narrowed and increased fineness can be accommodated for readily.

11 Claims, 2 Drawing Sheets

PLASMA DISPLAY PANEL AND MANUFACTURING METHOD THEREOF

BACKGROUND OF THE INVENTION

1. Technical Field of the Invention

This invention relates to a plasma display panel, which is favorable as a flat display panel, and a manufacture method thereof, and in particular relates to a plasma display panel and a manufacturing method thereof, with which the productivity is improved by reduction of the number of manufacturing processes.

2. Description of the Related Art

Plasma display panels (PDP) can be classified according to the operation method into an AC type, in which the electrodes are covered with a dielectric and which is operated indirectly in the AC discharge condition, and a DC type, in which the electrodes are exposed to the discharge space and which is operated in the DC discharge condition. AC type plasma display panels can furthermore be classified according to drive method into a memory operation type, with which the memory of a display cell is used, and a refresh operation type, with which the memory of a display cell is not used. The luminance of a plasma display is proportional to the number of times of discharge. Since the luminance decreases as the display capacity increases in the case of said refresh type, this type is mainly used as plasma displays of low display capacity.

FIG. 1 is an exploded perspective view, which shows a display cell of a prior-art AC type plasma display panel. The display cell is provided with two insulating substrates 101 and 102 that are formed of glass. Insulating substrate 101 serves as the rear panel substrate and insulating substrate 102 serves as the front panel substrate.

Transparent electrodes 103 and 104 are provided at the side of insulating substrate 102 that opposes insulating substrate 101. Transparent electrodes 103 and 104 extend in the horizontal direction (transverse direction) of the panel. Also, bus electrodes 105 and 106 are disposed so as to overlap with transparent electrode 103 and common electrode 104, respectively. Each of bus electrodes 105 and 106 is a thin film electrode of approximately 1 to 4 $\mu$m thickness comprising, for example, a CrCu thin film or Cr thin film and is provided to lessen the electrode resistance value between each electrode and an external drive device. A scanning electrode 115 is arranged from transparent electrode 103 and bus electrode 105, and a common electrode 116 is arranged from transparent electrode 104 and bus electrode 106. Furthermore a dielectric layer 112, which covers transparent electrodes 103 and 104, and a protective layer 114, which is formed of magnesium oxide, etc. and protects the dielectric layer 112 from discharge, are provided.

A data electrode 107, which is perpendicular to scanning electrode 103 and common electrode 104, is disposed at the side of insulating substrate 101 that opposes insulating substrate 102. Data electrode 107 thus extends in the vertical direction (longitudinal direction) of the panel. Barrier ribs 109, each of which extends in the longitudinal direction and partitions display cells that neighbor each other in the horizontal direction, are also provided. A dielectric layer 113, which covers data electrode 107, is provided, and on the side faces of barrier ribs 109 and the top surface of dielectric layer 113 is formed a fluorescent layer 111, which converts ultraviolet rays, which are generated by discharge of discharge gas, into visible light 110. A discharge gas space 108 is secured in the space between insulating substrates 101 and 102 by barrier ribs 109, and the interior of this discharge gas space 108 is filled with helium, neon, or xenon, etc. or a mixed gas of such gases.

Barrier ribs 109 are formed for example by layering a layer of frit glass on dielectric layer 113 and processing this layer to a predetermined shape by the sand blasting method.

With a plasma display panel that has been arranged thus, when the potential difference between scanning electrode 115 and common electrode 116 exceeds a predetermined value, discharge occurs and an emission 110 is thereby obtained.

Recently, plasma display panels that are finer are being required and the narrowing of the pitch of scanning electrode 103 and common electrode 104, which are the row electrodes, is deemed necessary. However, with a prior-art plasma display panel with the above-described arrangement, if just the pitch of the row electrodes is simply narrowed, erroneous discharge can occur due to interference of discharge among display cells that neighbor each other in the vertical direction and the image quality degrades accordingly in some cases.

Thus various plasma display panels have been proposed with which the rear panel substrate is provided with barrier ribs that take on a crisscross form and extend not only in the vertical direction but are also equipped with parts that extend in the horizontal direction and partition display cells that neighbor each other in the vertical direction (Japanese Unexamined Patent Publication No. 2001-93425, etc.).

If in the case where barrier ribs of crisscross form are employed, the height of the barrier ribs are made uniform, gas paths cannot be secured for the exhausting of the interior of the discharge space and the sealing of discharge gas in the discharge space, which are to be performed after adhering the front panel substrate and rear panel substrate together, and the manufacture process is thus made extremely difficult. Though it is possible for some amount of gas to flow since the surfaces of the barrier ribs and the surface of the protective layer are not perfectly flat, with just these conditions, the efficiency is extremely low and the productivity is significantly lowered.

Thus with the plasma display panel described in Japanese Unexamined Patent Publication No. 2001-93425, the height of the parts that extend in the longitudinal direction is made higher than the height of the parts that extend in the horizontal direction and the height of the intersections of these parts is made higher than the height of the parts that extend in the longitudinal direction.

With such a structure, gas paths for the exhausting and sealing processes can be secured and the efficiency is improved.

However, in manufacturing the plasma display panel described in Japanese Unexamined Patent Publication No. 2001-93425, the barrier rib parts that extend in the longitudinal direction must be formed after forming the parts that extend in the transverse direction. Thus in comparison to a prior arrangement provided with barrier walls comprising just parts that extend in the longitudinal direction, the number of processes is increased by the amount corresponding to the process of forming the barrier rib parts that extend in the transverse direction and the cost is thus increased.

Also, though barrier rib forming methods besides the sand blasting method include the printing method, etc., in the case where barrier ribs are to be provided with height differences, the number of processes will be increased correspondingly, no matter which method is employed.

Meanwhile, a plasma display panel, with which protruding parts are provided at regions of the dielectric layer of the front panel substrate that oppose the barrier ribs, has been disclosed for example in Japanese Unexamined Patent Publication No. Hei-8-250029, and by combining such a front panel substrate with barrier ribs of crisscross form of uniform height, gas paths may be secured while avoiding an increase in the number of processes for forming the barrier ribs.

However, since a process for forming protruding parts on the dielectric layer is newly required, increase of the overall number of processes cannot be avoided, and thus the productivity is lowered and the cost is increased in this case as well.

SUMMARY OF THE INVENTION

An object of the present invention is to provide a plasma display panel, which can be accommodated for increased fineness without lowering of productivity, and a manufacture method thereof.

A plasma display panel according to the present invention comprises a front panel substrate and a rear panel substrate that are disposed in opposing manner. Said rear panel substrate comprises an insulating substrate, barrier ribs, which are provided at the side of the insulating substrate that opposes said front panel substrate and which define display cells to block the transmission of discharge among neighboring display cells by said barrier ribs, first fluorescent layers, which are provided inside said display cells and convert the discharge generated inside the display cells into visible light, and second fluorescent layers, which are formed of the same materials as the first fluorescent layers and are selectively formed on said barrier ribs, thereby spaces are selectively formed between said barrier ribs and said front panel substrate.

Said second fluorescent layers may be formed on said barrier ribs, which are disposed between mutually neighboring display cells in which are formed the first fluorescent layers that convert the discharge to visible light of the same color with each other.

Also, said display cells may be arranged in matrix form, said barrier ribs may take on a crisscross form, first fluorescent layers that convert the discharge into visible light of the same color may be provided according to column in display cells that form a column in the direction perpendicular to the direction in which the scanning lines extend, and said second fluorescent layers may be formed on said barrier ribs disposed between all mutually neighboring display cells in at least one column of said display cells.

The thickness of said second fluorescent layer is preferably 5 to 15 $\mu$m.

With the present invention, spaces of approximately the same thickness as the second fluorescent layers exist between the barrier ribs and the front panel substrate, and in the process of exhausting the gas inside discharge spaces after adhesion of the front panel substrate and the rear panel substrate and prior to the sealing in of discharge gas in the manufacturing process, said spaces are used as exhaust paths for making the gas inside the discharge spaces reach exhaust tubes readily and be exhausted to the exterior. Likewise in the process of sealing in discharge gas, said spaces are used as introduction paths for making the discharge gas reach the interiors of the respective discharge spaces readily. The lowering of the exhaust efficiency and the efficiency of sealing can thus be avoided even if each display cell is surrounded by barrier ribs. As a result, discharge gas can be made to exist appropriately in the discharge spaces without fail and excellent display characteristics can be obtained. Furthermore, since display cells that neighbor each other in the column direction are partitioned by the barrier ribs, erroneous discharge will not occur. The non-discharge gap can thus be narrowed and increased fineness can be accommodated for readily. Furthermore, since both the first and second fluorescent layers can be formed in the same process by screen printing, etc., cost increases due to increase in the number of processes can be avoided.

A plasma display manufacturing method according to the present invention comprises the steps of forming a front panel substrate, forming a rear panel substrate, and adhering said front panel substrate and rear panel substrate together. Said rear panel substrate is formed by the steps of forming, on an insulating substrate, barrier ribs, which partition display cells to block the transmission of discharge among neighboring display cells, and forming, respectively inside said display cells, first fluorescent layers, each of which converts the discharge generated in the corresponding display cell to visible light, and forming, selectively on said barrier ribs, second fluorescent layers, which are formed of the same materials as said first fluorescent layers.

Said first and second fluorescent layers may be formed by the step of forming said second fluorescent layers on said barrier ribs that are disposed between mutually neighboring display cells in which are formed first fluorescent layers that convert the discharge to visible light of the same color with each other.

Also, said display cells may be arranged in matrix form, said barrier ribs may take on a crisscross form. Said first and second fluorescent layers may be formed by the step of forming the first fluorescent layers, which convert the discharge into visible light of the same color, according to column in display cells that form a column in the direction perpendicular to the direction in which the scanning lines extend and forming said second fluorescent layers on said barrier ribs between all mutually neighboring display cells in at least one column of said display cells.

DETAILED DESCRIPTION OF THE PREFERRED EMBODIMENTS

Figure 2:
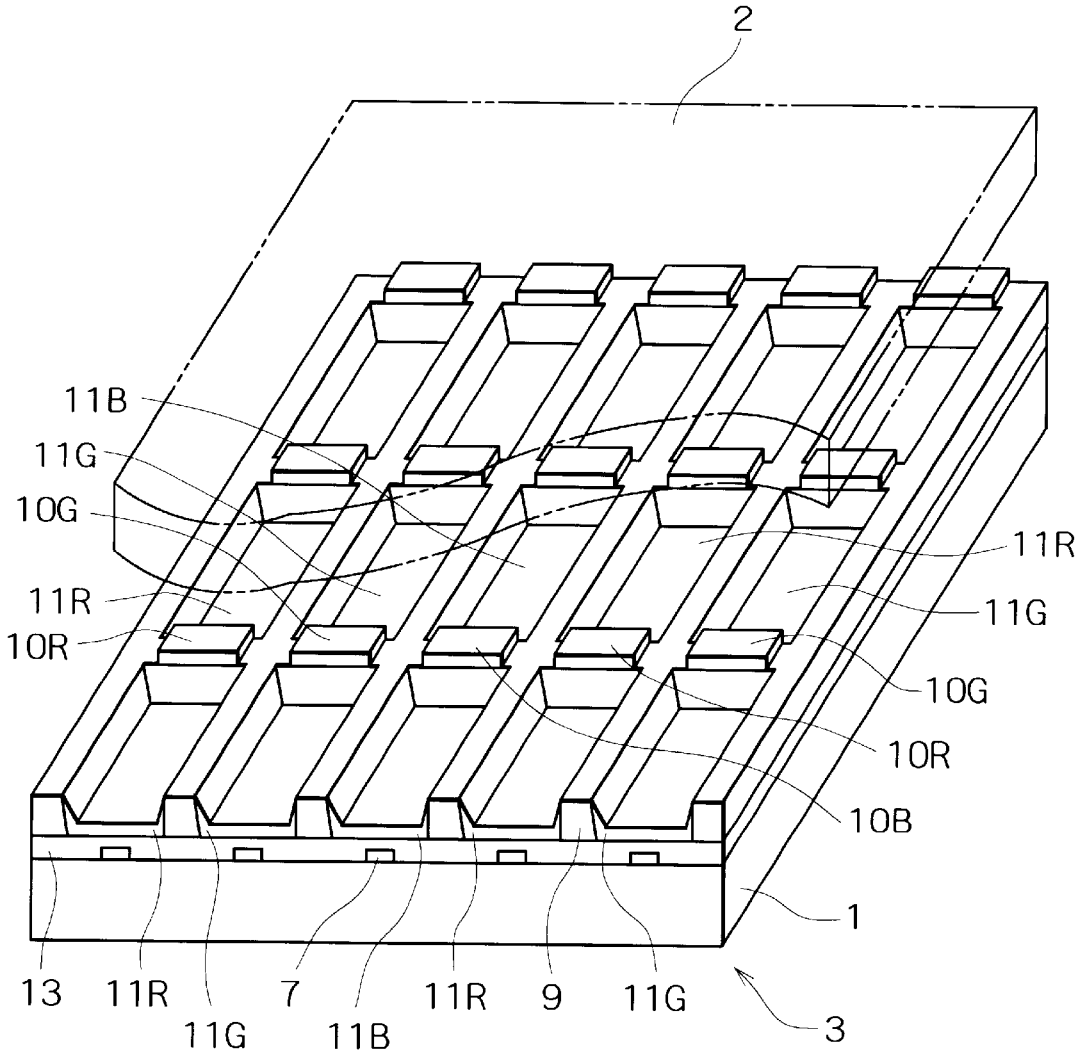
FIG. 2 is a perspective view of the rear panel substrate of the plasma display panel of an embodiment of this invention.

The plasma display panel and manufacturing method thereof of an embodiment of the present invention shall now be described specifically with reference to the attached drawings. FIG. 2 is a perspective view of the rear panel substrate of the plasma display panel of the embodiment of this invention.

Figure 1:
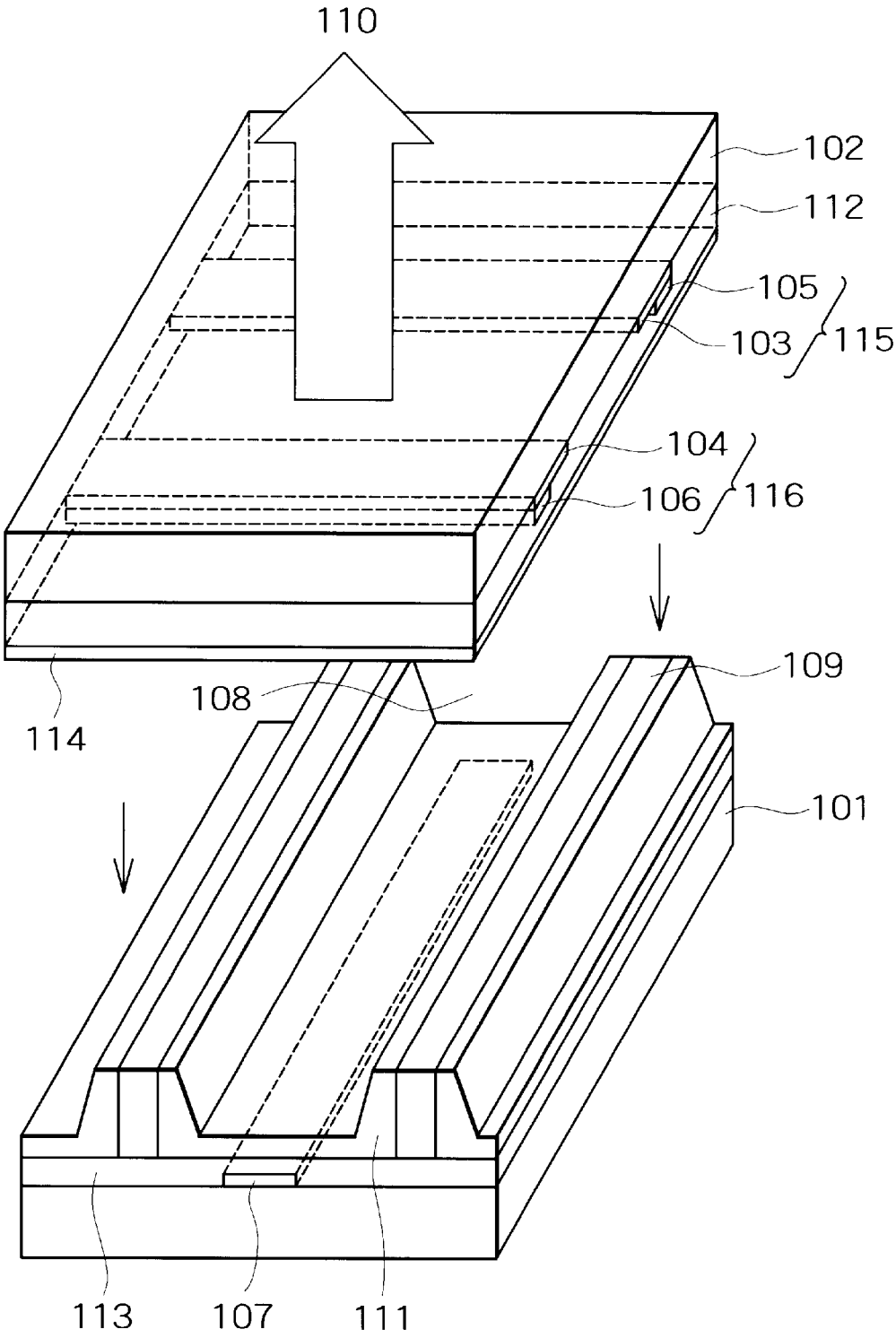
FIG. 1 (PRIOR ART)
FIG. 1 is an exploded perspective view of one display cell of a prior-art AC type plasma display panel.

As with the prior art, the plasma display panel of the present embodiment is arranged by adhering together a front panel substrate 2 and a rear panel substrate 3. The arrangement of front panel substrate 2 is the same as that of the prior art shown in FIG. 1 and is not illustrated in detail.

Meanwhile, on rear panel substrate 3, data electrodes 7, which are perpendicular to scanning electrodes and common electrodes that are the row electrodes, are provided at the side of an insulating substrate 1 that opposes front panel substrate 2. Also, a dielectric layer 13 that covers data electrodes 7 is formed over the entire surface. Furthermore, barrier ribs 9, which take on a crisscross form and partition display cells, are formed on dielectric layer 13. The barrier ribs 9 are, for example, uniform in height. Fluorescent layers (first fluorescent layers) 11R, 11G, and 11B, which convert ultraviolet rays generated by discharge of discharge gas to red, green, and blue visible light, respectively, are formed on the side faces of barrier ribs 9 and the top surface of dielectric layer 13. Fluorescent layers that convert ultraviolet rays to visible light of the same color are aligned in a column, and columns of fluorescent layers 11R, 11G, and 11B are for example repeated in this order in the row direction (in the direction in which the scanning lines extend). With the present embodiment, fluorescent layer (second fluorescent layers) 10R, 10G, and 10B of, for example, 5 to 15 $\mu$m thickness are formed on regions of barrier ribs 9 positioned between display cells that neighbor each other in the column direction. Fluorescent layers 10R, 10G, and 10B are disposed within columns of fluorescent layers 11R, 11G, and 11B, respectively.

Front panel substrate 2 and rear panel substrate 3 are adhered together with the surfaces of fluorescent layers 10R, 10G, and 10B being put in contact with the surface of a protective layer of front panel substrate 2.

With the present embodiment arranged in the manner described above, spaces of approximately the same thickness as fluorescent layers 10R, 10G, and 10B exist between the regions of barrier ribs 9 that extend in the column direction and the protective layer. Thus in the process of exhausting the gas inside discharge spaces after adhesion of the front panel substrate and the rear panel substrate and prior to the sealing in of discharge gas in the manufacturing process, said spaces are used as exhaust paths for making the gas inside the discharge spaces reach exhaust tubes readily and be exhausted to the exterior. The lowering of the exhaust efficiency in comparison to the prior-art plasma display panel, which is provided with stripe-like barrier ribs comprising only regions that extend in the column direction, can thus be avoided. Likewise, in the process of sealing in discharge gas, said spaces are used as introduction paths for making the discharge gas reach the interiors of the respective discharge spaces readily. The lowering of the efficiency of sealing in discharge gas in comparison to the prior-art plasma display panel, which is provided with stripe-like barrier ribs, can thus be avoided. As a result, discharge gas can be made to exist appropriately in the discharge spaces without fail and excellent display characteristics can be obtained. Furthermore, since display cells that neighbor each other in the column direction are partitioned by barrier ribs 9, interference of discharge will not occur. The non-discharge gap can thus be narrowed and increased fineness can be accommodated for readily.

The method of manufacturing the rear panel substrate 3 of the above-described plasma display panel of the embodiment of this invention shall now be described.

First, data electrodes 7 are formed on predetermined positions of insulating substrate 1 and dielectric layer 1 is formed over the entire surface.

Frit glass (not shown) is then layered on top of dielectric layer 13 and barrier ribs 9 are formed by processing the frit glass into a crisscross form by the sand blasting method.

Thereafter, fluorescent layers 10R and 11R, fluorescent layers 10G and 11G, and fluorescent layers 10B and 11B are formed according to column for example by the screen printing method. To be more specific, in forming for example the fluorescent layers 10R and 11R, a screen plate is set so as to mask, in the form of straight lines, regions that extend in the column direction of barrier ribs 9 positioned at both sides of the corresponding column, the regions surrounded by barrier ribs 9 of the corresponding column are then filled with a raw material paste for fluorescent layers 10R and 11R using a squeegee and via the screen plate, and the raw material paste for fluorescent layers 1OR and 11R are printed onto regions of barrier ribs 9 that extend in the row direction. The solvent component in the raw material paste is evaporated by drying the raw material to thereby obtain fluorescent layers 10R and 11R of conical form. The same applies to fluorescent layers G and 11G and fluorescent layers 10B and 11B.

Rear panel substrate 3 can be manufactured in such a manner.

To complete the plasma display panel, front panel substrate 2 is manufactured separately and thereafter, the front panel substrate and rear panel substrate are adhered together and the exhausting of the interiors of the discharge spaces, sealing in of discharge gas, etc. are performed.

With this manufacturing method, since the deposition and the processing of the frit glass has to be performed only once each in relation to the formation of barrier ribs 9, the number of processes is not increased in comparison to the case where stripe-like barrier ribs are formed.

Also since there is no need to mask regions of barrier ribs 9 that extend in the row direction in the screen printing process, the shape of the screen plate is simplified.

Though the thickness of the fluorescent layer on the barrier ribs is not restricted in particular, it tends to be difficult to obtain an adequate exhaust efficiency if the thickness is less than 5 $\mu$m. On the other hand, if the thickness exceeds 15 $\mu$m, interference of discharge tends to occur readily between neighboring display cells, especially, display cells that neighbor each other in the row direction. The thickness of the fluorescent layer on the barrier ribs is thus preferably 5 to 15 $\mu$m. The fluorescent layer inside a cell normally has a thickness of approximately 10 to 25 $\mu$m and is thus thicker than the layer on the barrier ribs. This is because when the raw material paste of the fluorescent layer is coated, a large amount of raw material paste, corresponding to the volume of the cavity inside a cell, is placed in the cell. Actually, the thickness of the fluorescent layer is thickest at the bottom part and becomes thinner at the side faces and the thickness of the fluorescent layer on the barrier ribs is approximately equal to or thinner than the thickness of the fluorescent layer at the upper parts of the side faces of a cell.

Also, the method of forming the barrier ribs is not limited to the sand blasting method, and a method of forming a laminated film as a barrier rib by repeating screen printing 8 to 10 times, a method of performing patterning by applying a photolithography technique to a photosensitive barrier rib material, etc., may be employed instead. Likewise, the method of forming the fluorescent layer is not limited to screen printing and the raw material may be coated on by a dispenser. Though in the case where coating by a dispenser is to be performed on a prior-art plasma display panel, the discharge of raw material and stoppage of this discharge must be repeated for each display cell, with the present invention, there is no need to stop the discharge of raw material and this operation is thus simplified. Also, patterning may be performed by applying a photolithography technique to a photosensitive fluorescent layer material. The advantages that the pattern is simplified and the occurrence of defects is restrained are provided in this case as well.

Furthermore, the regions of the barrier ribs at which fluorescent layers are to be formed are not limited to regions that extend in the row direction, and if mixed colors are not to be generated along with fluorescent layers that convert ultraviolet rays to visible light of other colors, fluorescent layers may be formed on regions that for example extend in the column direction. Also, there is not need to provide fluorescent layers on barrier ribs between all display cells, and for example in the above-described embodiment, just the fluorescent layer 10R can be provided without the other fluorescent layers 10G and 10B being provided. In this case, a wider path is secured for the exhaust and introduction of gas. Furthermore, within a single column of display cells, for example, one fluorescent layer may be provided for three display cells. Yet furthermore, a film containing microparticles of titanium oxide, etc. may be formed between the respective fluorescent layers and the barrier ribs and the dielectric layer for the purpose of restraining the biasing of the fluorescent layer. As has been described above, with the present invention, since spaces of substantially the same thickness as the second fluorescent layers exist between the barrier ribs and the front panel substrate, the lowering of the efficiency of exhaust and the efficiency of sealing can be avoided even if the respective display cells are surrounded by barrier ribs. As a result, discharge gas can be made to exist appropriately in the discharge spaces without fail, thereby enabling excellent display characteristics to be obtained. Also, since the first and second fluorescent layers can be formed together in the same process by screen printing, etc., cost increases due to an increase in the number of processes can be avoided. Furthermore, since display cells that neighbor each other in the column direction are partitioned by the barrier ribs, erroneous discharge will not occur. The non-discharge gap can thus be narrowed and increased fineness can be accommodated for readily.

What is claimed is:

1. A plasma display panel, comprising:

a front panel substrate and a rear panel substrate that are disposed in opposing manner, said rear panel substrate comprising:

an insulating substrate;

barrier ribs, which are provided at the side of the insulating substrate that opposes said front panel substrate and which define display cells to block the transmission of discharge among neighboring display cells by said barrier ribs, said barrier ribs being formed so as to form spaces selectively between said barrier ribs and said front panel substrate;

first fluorescent layers, which are provided inside said display cells and convert the discharge generated inside the display cells into visible light; and second fluorescent layers, which are formed of the same materials as the first fluorescent layers and are selectively formed on said barrier ribs.

2. The plasma display panel as set forth in claim 1, wherein said second fluorescent layers are formed on said barrier ribs which are provided between mutually neighboring display cells in which are formed first fluorescent layers that convert the discharge to visible light of the same color with each other.

3. The plasma display panel as set forth in claim 1, wherein said display cells are arranged in matrix form, said barrier ribs take on a crisscross form, first fluorescent layers that convert the discharge into visible light of the same color are provided according to column in display cells that form a column in the direction perpendicular to the direction in which the scanning lines extend, and said second fluorescent layers are formed on said barrier ribs between all mutually neighboring display cells in at least one column of said display cells.

4. The plasma display panel as set forth in claim 2, wherein said display cells are arranged in matrix form, said barrier ribs take on a crisscross form, first fluorescent layers that convert the discharge into visible light of the same color are provided according to column in display cells that form a column in the direction perpendicular to the direction in which the scanning lines extend, and said second fluorescent layers are formed on said barrier ribs between all mutually neighboring display cells in at least one column of said display cells.

5. The plasma display panel as set forth in claim 1, wherein the thickness of said second fluorescent layer is 5 to 15 $\mu$m.

6. The plasma display panel as set forth in claim 2, wherein the thickness of said second fluorescent layer is 5 to 15 $\mu$m.

7. The plasma display panel as set forth in claim 3, wherein the thickness of said second fluorescent layer is 5 to 15 $\mu$m.

8. A plasma display manufacturing method comprising the steps of:

forming a front panel substrate;

forming a rear panel substrate; and adhering said front panel substrate and rear panel substrate together;

said rear panel substrate being formed by the steps of:

forming, on an insulating substrate, barrier ribs, which partition display cells to block the transmission of discharge among neighboring display cells, and forming, respectively inside said display cells, first fluorescent layers, each of which converts the discharge generated in the corresponding display cell to visible light, and forming, selectively on said barrier ribs, second fluorescent layers, which are arranged from the same materials as said first fluorescent layers.

9. The plasma display manufacturing method as set forth in claim 8, wherein said first and second fluorescent layers are formed by the step of forming said second fluorescent layers on said barrier ribs which are provided between mutually adjacent display cells in which are formed first fluorescent layers that convert the discharge to visible light of the same color with each other.

10. The plasma display manufacturing method as set forth in claim 8, wherein said display cells are arranged in matrix form, said barrier ribs take on a crisscross form, and said first and second fluorescent layers are formed by the step of forming the first fluorescent layers, which convert the discharge into visible light of the same color, according to column in display cells that form a column in the direction perpendicular to the direction in which the scanning lines extend and forming said second fluorescent layers on said barrier ribs between all mutually neighboring display cells in at least one column of said display cells.

11. The plasma display manufacturing method as set forth in claim 9, wherein said display cells are arranged in matrix form, said barrier ribs take on a crisscross form, and said first and second fluorescent layers are formed by the step of forming the first fluorescent layers, which convert the discharge into visible light of the same color, according to column in display cells that form a column in the direction perpendicular to the direction in which the scanning lines extend and forming said second fluorescent layers on said barrier ribs between all mutually neighboring display cells in at least one column of said display cells.

* * * * *